US010946492B2

(12) United States Patent
Greenslet et al.

(10) Patent No.: US 10,946,492 B2
(45) Date of Patent: Mar. 16, 2021

(54) POLISHING TECHNIQUE FOR FLEXIBLE TUBES

(71) Applicant: University of Florida Research Foundation, Inc., Gainesville, FL (US)

(72) Inventors: Hitomi Greenslet, Gainesville, FL (US); Xueyu Du, Troy, MI (US); Valens Nteziyaremye, Beaverton, OR (US); Timothy Pham, Panama City Beach, FL (US)

(73) Assignee: University of Florida Research Foundation, Incorporated, Gainesville, FL (US)

( * ) Notice: Subject to any disclaimer, the term of this patent is extended or adjusted under 35 U.S.C. 154(b) by 486 days.

(21) Appl. No.: 15/767,479

(22) PCT Filed: Oct. 13, 2016

(86) PCT No.: PCT/US2016/056800

§ 371 (c)(1),
(2) Date: Apr. 11, 2018

(87) PCT Pub. No.: WO2017/066420

PCT Pub. Date: Apr. 20, 2017

(65) Prior Publication Data

US 2018/0311781 A1 Nov. 1, 2018

Related U.S. Application Data

(60) Provisional application No. 62/242,040, filed on Oct. 15, 2015.

(51) Int. Cl.
*B24B 29/08* (2006.01)
*B24B 31/112* (2006.01)
(Continued)

(52) U.S. Cl.
CPC ..... *B24B 29/08* (2013.01); *B24B 1/005* (2013.01); *B24B 31/112* (2013.01); *B24B 35/00* (2013.01);
(Continued)

(58) Field of Classification Search
CPC ..... B24B 1/005; B24B 29/08; B24B 31/12; B24B 37/025; B24B 41/061
(Continued)

(56) References Cited

U.S. PATENT DOCUMENTS 2,818,688 A * 1/1958 Lennart ..... B24B 5/40 451/49
2,831,296 A 4/1958 Griggs
(Continued)

OTHER PUBLICATIONS

International Search Report in co-pending, related PCT Application No. PCT/US16/56800, dated Jan. 12, 2017.
(Continued)

*Primary Examiner* — Eileen P Morgan
(74) *Attorney, Agent, or Firm* — Thomas | Horstemeyer, LLP

(57) ABSTRACT

Various examples are provided for polishing techniques for flexible tubular workpieces. In one example, a method includes supporting a tubular workpiece on a rod that extends axially through it; positioning a turning wheel against an external surface of the tubular workpiece, where it is held by magnetic attraction; and rotating the tubular workpiece by rotating the turning wheel. The external surface of the tubular workpiece is polished by the abrasive particles during rotation of the tubular workpiece. In another example, a polishing system includes a workpiece holder including a rod configured to axially support a tubular workpiece; a turning wheel with abrasive particles distributed about an outer surface; a wheel support assembly configured to position the outer surface of the turning wheel
(Continued)

against the an external surface of the tubular workpiece, where it is held by magnetic attraction. The external surface is polished during rotation of the tubular workpiece.

22 Claims, 12 Drawing Sheets

(51) Int. Cl.

| | |
|---|---|
| ***B24B 37/025*** | (2012.01) |
| ***B24B 41/06*** | (2012.01) |
| ***B24B 1/00*** | (2006.01) |
| ***B24B 35/00*** | (2006.01) |
| ***B24B 37/27*** | (2012.01) |
| ***B24B 37/02*** | (2012.01) |

(52) U.S. Cl.
CPC ..... *B24B 37/02* (2013.01); *B24B 37/025* (2013.01); *B24B 37/27* (2013.01); *B24B 41/061* (2013.01); *B24B 41/067* (2013.01)

(58) Field of Classification Search
USPC ..... 451/51, 104, 106, 109, 113, 242
See application file for complete search history.

(56) References Cited

U.S. PATENT DOCUMENTS

| | | | | |
|---|---|---|---|---|
| 3,594,955 | A * | 7/1971 | Collin | B24B 5/35 451/242 |
| 4,580,370 | A | 4/1986 | Smith | |
| 4,656,789 | A | 4/1987 | Schwar | |
| 8,708,778 | B2 * | 4/2014 | Greenslet | B24B 1/005 451/51 |
| 8,915,769 | B2 * | 12/2014 | Kamikihara | B24B 5/40 451/29 |
| 10,632,585 | B2 * | 4/2020 | Greenslet | B24B 1/005 |
| 2003/0216109 | A1 * | 11/2003 | Riviere | B24B 5/38 451/36 |
| 2006/0065518 | A1 | 3/2006 | Aiura et al. | |
| 2011/0301691 | A1 * | 12/2011 | Kamikihara | B24B 31/112 623/1.15 |
| 2018/0311781 | A1 * | 11/2018 | Greenslet | B24B 41/067 |
| 2019/0366501 | A1 * | 12/2019 | Greenslet | A61F 2/82 |

OTHER PUBLICATIONS

Forssmann-Falck, R., 1997, Werner Forssmann: A Pioneer of Cardiology, The American Journal of Cardiology, vol. 79, No. 5, pp. 651-660.

Htay, T., and Liu, M.W., 2005, Drug-eluting Stent: A Review and Update., Vascular Health and Risk Management, vol. 1, No. 4, pp. 263-276.

Hermawan, H., Dubé, D., and Mantovani, D., 2010, Developments in Metallic Biodegradable Stents, Acta Biomaterialia, vol. 6, No. 5, pp. 1693-1697.

Walter, R., and Kannan, M.B., 2011, Influence of Surface Roughness on the Corrosion Behaviour of Magnesium Alloy, Materials and Design, vol. 32, No. 4, pp. 2350-2354.

* cited by examiner

| | |
|---|---|
| Workpiece | Magnesium alloy (AZ61) tube samples: ∅1.8×∅1.5×13 mm |
| Abrasive | Diamond abrasive: 0-1, 2-4 μm mean diameter |
| Rod | Carbon steel: ∅0.84×70 mm |
| Wheel revolution | 200 $min^{-1}$ |
| Tape | Vinyl-coated cloth tape: 30 mm wide, 0.28 mm thick |
| Lubricant | Soluble-type barreling compound, 2 mL/5 min |

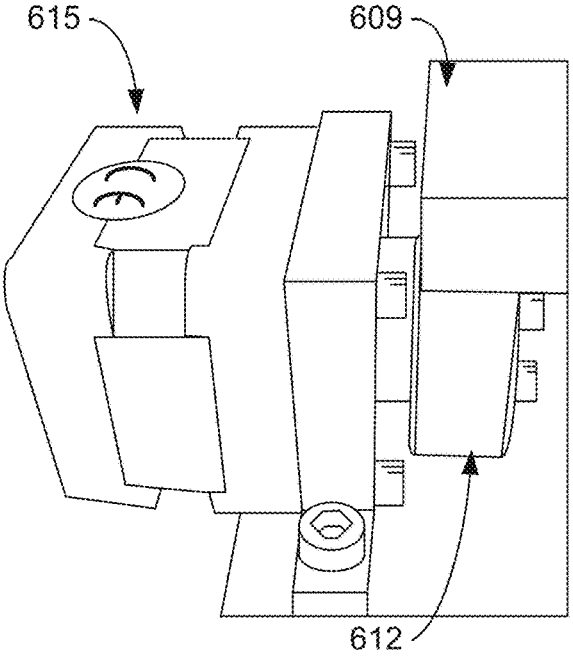
FIG. 6C
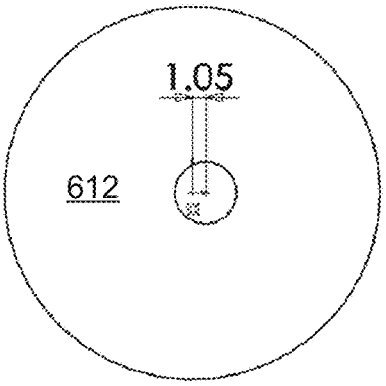
FIG. 6D
FIG. 6E
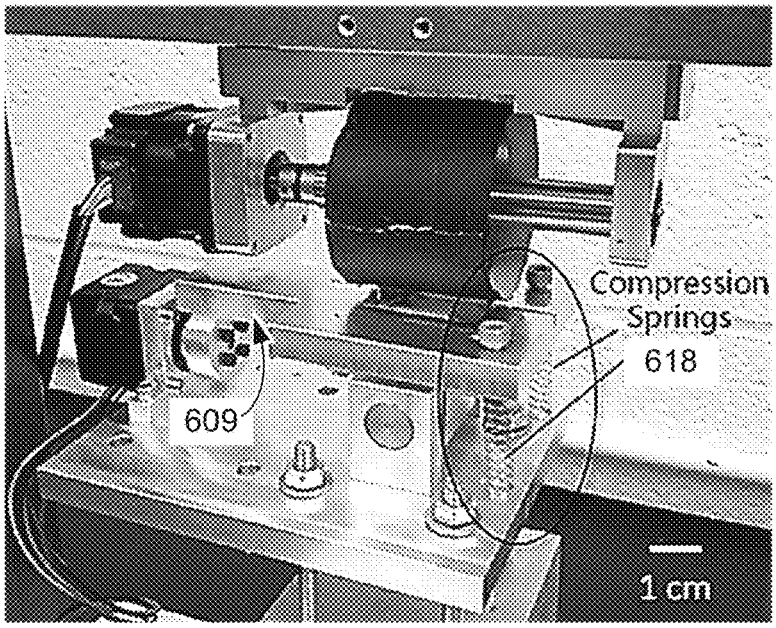

POLISHING TECHNIQUE FOR FLEXIBLE TUBES

CROSS-REFERENCE TO RELATED APPLICATION

This application is the 35 U.S.C. § 371 national stage application of PCT Application No. PCT/US2016/056800, filed Oct. 13, 2016, which claims priority to, and the benefit of U.S. provisional application entitled "Polishing Technique for Flexible Tubes" having Ser. No. 62/242,040, filed Oct. 15, 2015, both of which are which is hereby incorporated by reference in its entirety their entireties.

BACKGROUND

The treatment of coronary artery disease (CAD) dates back to the late 1920s, when cardiac catheterization was first implemented in the human body by Werner Forssmann. Building on the developments by various researchers, expandable meshed metallic scaffolding, called a stent, was introduced in the 1980s. The development of biodegradable materials has enabled the development of two major types of biodegradable stents, the polymer-based stent and the metal-based stent, which have increasingly attracted attention, especially in the last twenty years. The good balance of biocompatibility, biodegradability, and mechanical strength of magnesium alloys make them promising materials for metallic biodegradable stents.

SUMMARY

Embodiments of the present disclosure are related to polishing techniques for tubular workpieces such as, e.g., stents and other flexible or rigid tubes.

In one embodiment, among others, a method comprises supporting a tubular workpiece on a rod that extends axially through the tubular workpiece; positioning an outer surface of a turning wheel against an external surface of the tubular workpiece, where the outer surface comprises abrasive particles and the external surface of the tubular workpiece is held against the outer surface by magnetic attraction between the rod and the turning wheel; and rotating the tubular workpiece by rotating the turning wheel, where the external surface of the tubular workpiece is polished by the abrasive particles during rotation of the tubular workpiece. In one or more aspects of these embodiments, the tubular workpiece can be axially oscillated on the rod during rotation. The turning wheel can have a cylindrical-shape or barrel-shape with a center diameter greater than an end diameter of the magnetic turning wheel. In one or more aspects of these embodiments, the method can comprise rocking the rod about a center of the turning wheel thereby producing an axial reciprocation of the tubular workpiece. An internal surface of the tubular workpiece can be polished during rotation of the tubular workpiece. The rod can be wrapped in a thread or fiber. The tubular workpiece can be a flexible tubular workpiece or a straight tubular workpiece. The flexible tubular workpiece can be a stent.

In another embodiment, a polishing system comprises a workpiece holder comprising a rod configured to axially support a tubular workpiece; a turning wheel comprising an internal magnet and abrasive particles distributed about an outer surface of the turning wheel; a wheel support assembly configured to position the outer surface of the turning wheel against the external surface of the tubular workpiece supported by the rod, where the external surface of the tubular workpiece is held against the outer surface by magnetic attraction between the rod and the internal magnet; and a turning wheel drive configured to turn the tubular workpiece on the rod by rotating the turning wheel, where the external surface of the tubular workpiece is polished by the abrasive particles during rotation of the tubular workpiece. In one or more aspects of these embodiments, the workpiece holder can be configured to axially oscillate the tubular workpiece on the rod during rotation by the turning wheel. The workpiece holder can be tilted in a rocking motion to cause the tubular workpiece to axially oscillate while rotating. The workpiece holder can be oscillated to axially reciprocate the tubular workpiece when rotated.

In one or more aspects of these embodiments, the turning wheel can have a cylindrical-shape or barrel-shape with a center diameter greater than an end diameter of the turning wheel. The outer surface of the turning wheel can include one or more layers of cushioning. The internal magnet can be a permanent magnet. The rod can be made of ferromagnetic materials. The rod can be coated with non-ferromagnetic materials. The rod can be wrapped in a thread or fiber. In one or more aspects of these embodiments, the abrasive particles can comprise abrasive particles having a mean diameter of less than or equal to 4 μm. The abrasive particles can have a mean diameter of less than or equal to 1 μm. The tubular workpiece can be a straight tubular workpiece or flexible tubular workpiece. The tubular workpiece can be a biodegradable stent.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 6A through 6F illustrate an example of a finishing system configured to oscillate a workpiece holder with an eccentric wheel (or cam), in accordance with various embodiments of the present disclosure.

FIG. 100 includes images of an internal surface of a stent before and after polishing using the finishing system of FIGS. 6A-6F, in accordance with various embodiments of the present disclosure.

DETAILED DESCRIPTION

Figure 1A:
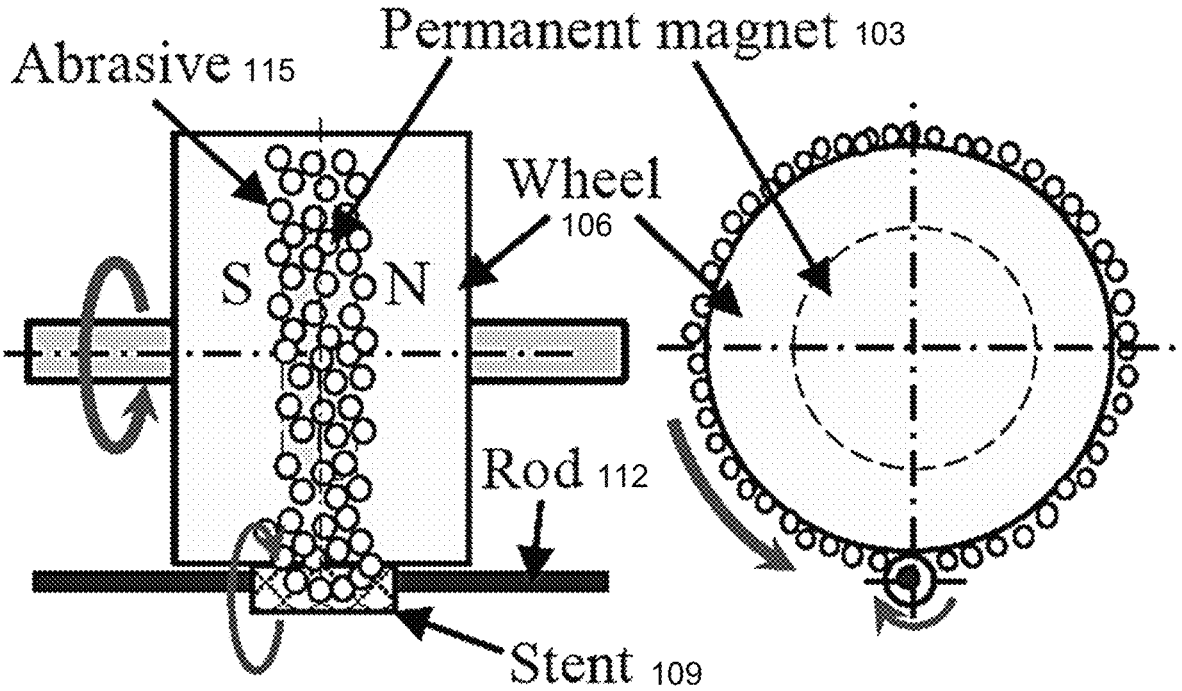
FIGS. 1A and 1B are a graphical representation illustrating an example of a finishing (or polishing) system for processing a flexible tube such as a stent, in accordance with various embodiments of the present disclosure.

Disclosed herein are various embodiments of methods related to polishing of flexible tubes such as, e.g., stents. Polishing can be carried out on internal and/or external surfaces of the flexible tubes. Reference will now be made in detail to the description of the embodiments as illustrated in the drawings, wherein like reference numbers indicate like parts throughout the several views.

The development of biodegradable materials has enabled the development of two major types of biodegradable stents, the polymer-based stent and the metal-based stent, which have increasingly attracted attention. Magnesium alloys are promising materials for metallic biodegradable stent manufacturing because of their good balance of biocompatibility, biodegradability, and mechanical strength. In some implementations, magnesium alloy stents can be coated with biodegradable polymers (e.g., PLLA), and/or antiproliferative and antithrombosis drugs, to slow down the degradation rate. In order to achieve enhanced coatability and an effective rate of degradation, surface finishing can be used for smoothing the surface and removing burrs produced by the heat ablation of the laser-cutting operation used to produce the meshed stent. This disclosure presents a finishing processing principle for flexible tubes such as, e.g., magnesium alloy stents and describes an experimental setup designed to realize the principle. Finishing experiments were conducted using magnesium alloy tubes and stents to demonstrate the feasibility and finishing characteristics of the process.

Magnesium alloy stent manufacturing processes begin with cutting an ingot into cylindrical billets, and then hot-extruding the billets into tubes (e.g., with an outer diameter of about 3 mm, approximately 220 μm thick, and about 1 m long). The tubes are then annealed for the later cold drawing. The annealed thin-wall tubes can be repeatedly thinned by drawing and annealing processes until the tubes reach the thickness and outside diameter (e.g., about 150 μm thick and about 1.8 mm in diameter). A laser-cutting method can be used to generate the meshed tubular geometry through accurate and flexible cuts (e.g., with movement within 1-2 μm). Annealing can release the residual stresses created by the drawing and laser cutting, however burrs and surface defects from the heat ablation can remain on the outside surface of the stent.

Surface quality is important for biodegradable stents because it affects not only the coatability, but also eases the insertion and the rate of degradation in the human body. Research on magnesium alloy AZ91 showed that the surface roughness can generally influence the rate of corrosion. Increasing the surface roughness can affect the passivation tendency and increases the pitting susceptibility of the alloy. Therefore, an effective finishing process can prolong the life of the stent and prevent damage to the arterial vessel in which it is implanted.

This disclosure describes the processing principle and finishing equipment developed to realize surface finishing of stents. This disclosure also includes a description of the finishing characteristics and the identification of parameters that help to prove the concept.

Processing Principle and Finishing Equipment

Figure 1B:
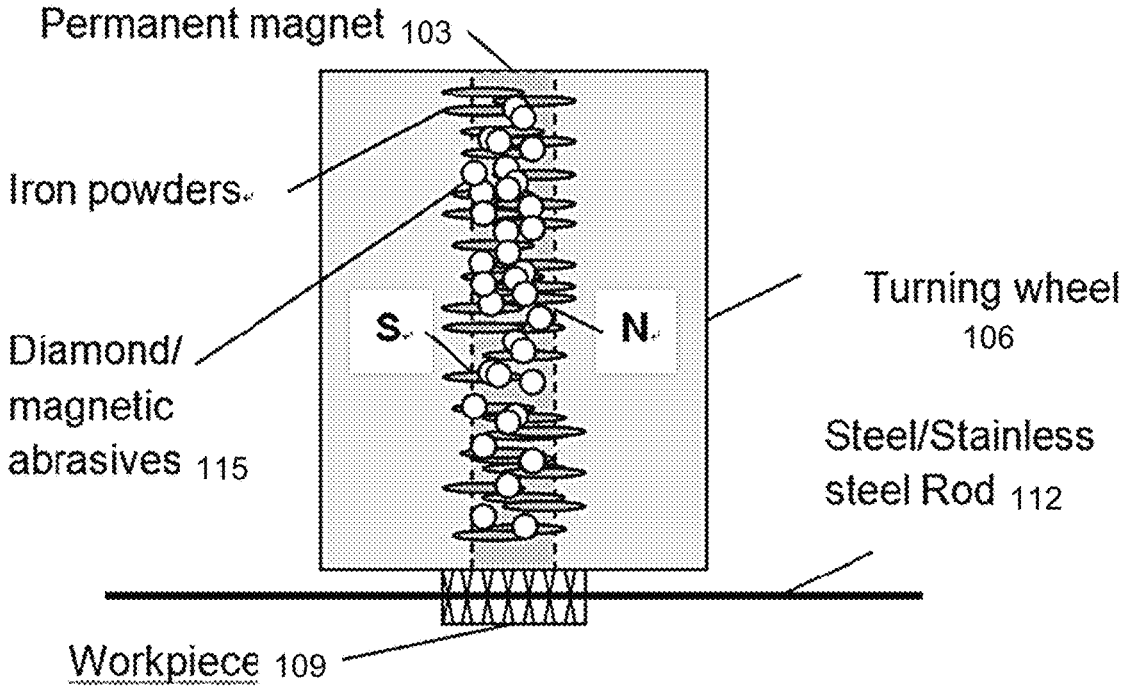

Minimizing the creation of uneven stress in a stent during finishing can avoid impairing the stent's performance. Unlike workpieces finished with other mechanical machining processes, stents should not be rigidly clamped or chucked for finishing. Referring to FIGS. 1A and 1B, shown is a schematic representation illustrating the processing principle disclosed in this research. A permanent magnet 103 is installed inside a turning wheel 106 made of austenitic stainless steel. Instead of direct clamping, the stent (or other workpiece) 109 is held magnetically between a ferromagnetic rod 112 (e.g., a carbon steel rod) inserted into the stent 109 and the turning wheel 106. The ferromagnetic rod 112 can be coated to avoid direct contact with the workpiece 109. The result of the weight of the wheel 106 and the magnetic force on the rod 112 acts on the stent 109. The stent 109 rotates as it is passively driven by the turning wheel 106. Once abrasive 115 is introduced to the surface of the wheel 106, the abrasive 115 is sandwiched between the wheel 106 and the workpiece 109. The abrasive 115 can include diamond and/or magnetic abrasives. Iron powders can be used as a holder to transfer magnetic force to the abrasive 115. The relative motion between the abrasive 115 and stent 109 finishes the stent surface and edges.

Figure 2A:
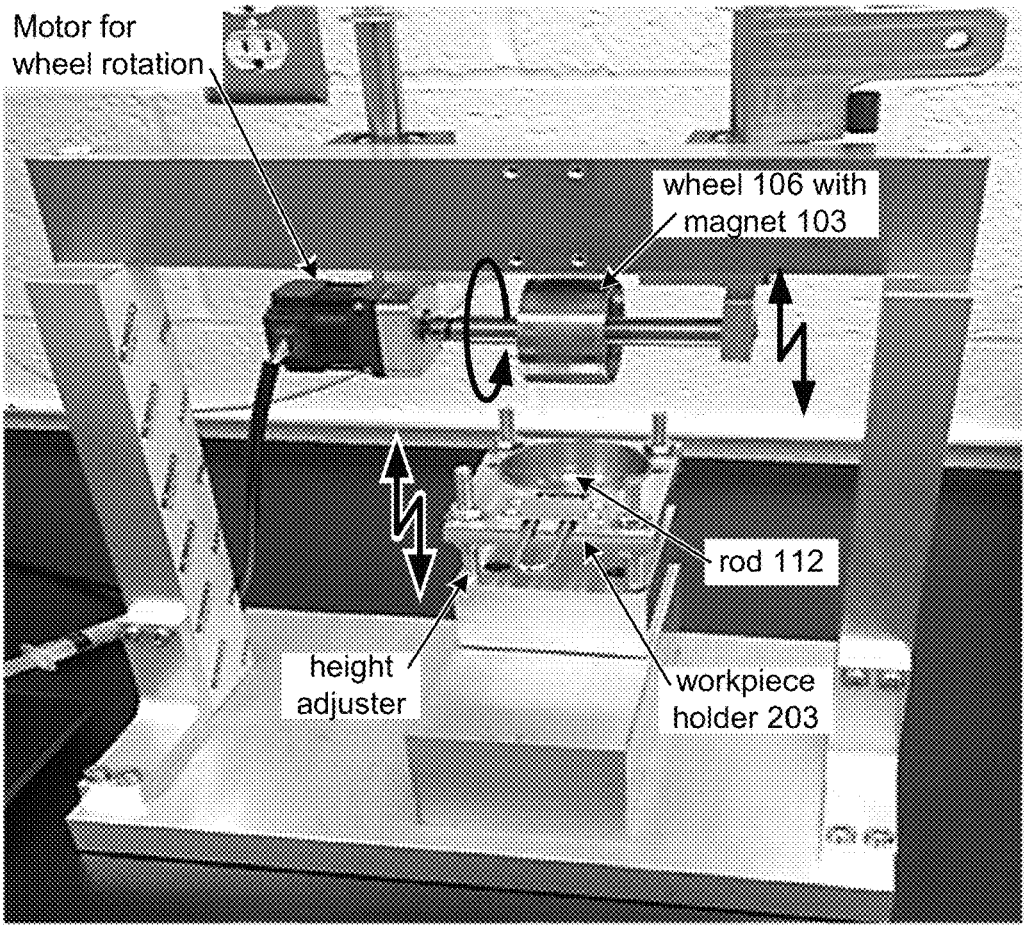
FIG. 2A shows an image of the finishing system of FIG. 1, in accordance with various embodiments of the present disclosure.
Figure 2B:
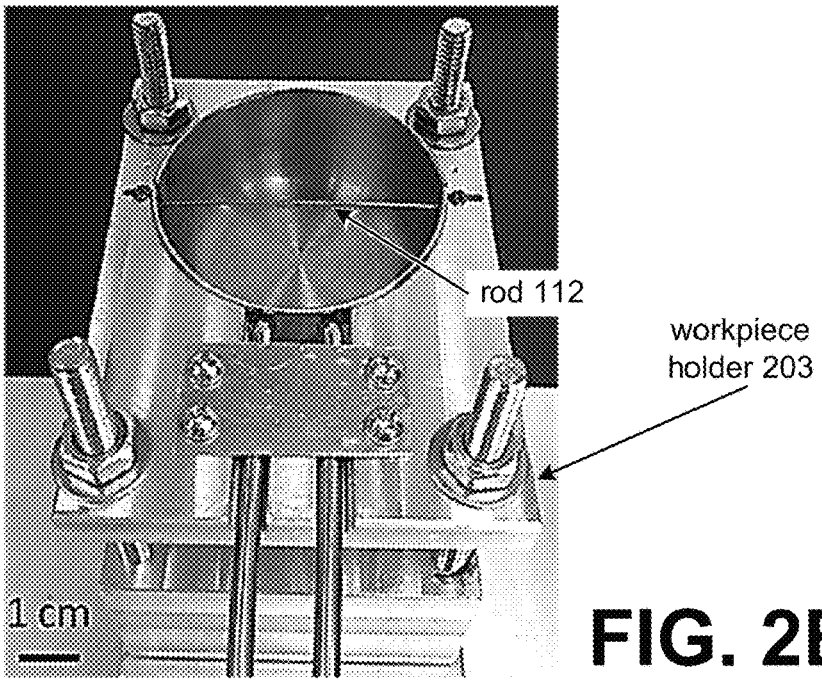
FIG. 2B is an image of the surface of a vinyl-coated cloth tape used in the finishing system of FIG. 1, in accordance with various embodiments of the present disclosure.

FIG. 2A shows an image of an example of a polishing system including the finishing equipment developed to realize the disclosed processing principle. A workpiece (e.g., AZ61 tube and stent (Ø1.8×Ø1.5×13 mm)) 109 (FIG. 1) with a rod 112 passing through the inside is set on the workpiece holder 203 and the turning wheel 106 is set down on the workpiece 109. FIG. 2B is an enlarged view showing the rod 112 positioned in the workpiece holder 203. The workpiece holder 203 includes grooves to receive the rod 112 and hold it in position over a recessed cavity. Set screws on each side of the rod 112 can be used to secure it in the grooves. The wheel 106 (Ø54.8×30 mm) includes a Nd—Fe—B permanent magnet 103 (Ø25.4×Ø12.7×6.35 mm). The contact force with the turning wheel 106 can be altered by adjusting the workpiece height. The polishing system can include linear slides to adjust the positioning, and thus the contact force of the turning wheel 106. Rotation of the wheel 106 can be provided by a motor (e.g., a brushless DC motor) coupled to a shaft supporting the wheel 106 through a flexible coupling. The wheel rotation drives the workpiece rotation needed for surface finishing. The speed of the motor can be controlled through drive circuitry controlled by, e.g., a microcontroller to adjust the rotational speed of the turning wheel 106. For example, the rotational speed can be varied over a range from 0 $min^{-1}$ (standstill) to 300 $min^{-1}$, to about 500 $min^{-1}$ or to higher speeds.

Figures 2C, 3:
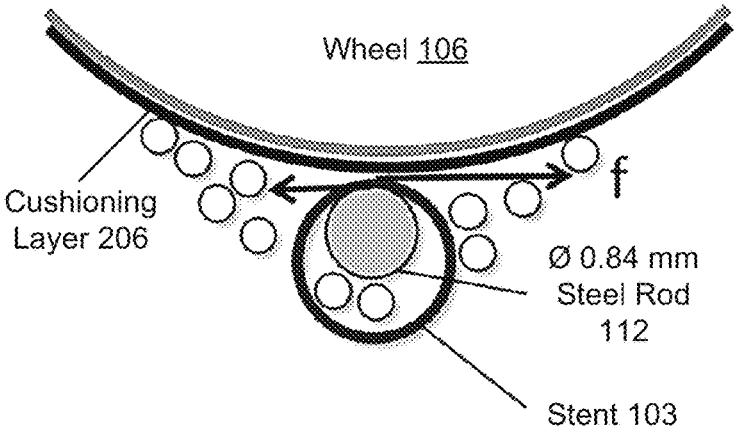
FIG. 2C shows a side view of a turning wheel in contact with a stent, in accordance with various embodiments of the present disclosure.
FIG. 3 is a table showing the experimental conditions of tube finishing experiments utilizing the finishing system of FIG. 1, in accordance with various embodiments of the present disclosure.

FIG. 2C shows a side view of the turning wheel 106 in contact with a stent 109 supported by a stainless steel rod 112. Magnetic force on the rod 112 and friction of the wheel surface on the outside surface of the stent or workpiece 109 can transmit the rotational motion of the wheel 106 to the workpiece 109 so that the surface can be evenly polished. A cushioning layer 206 can be included on the surface of the turning wheel 106 to hold the abrasive 115 in place, to prevent from damaging the workpiece 109 surface, and to alter the coefficient of friction between the workpiece 109 and turning wheel 106 surfaces. For example, the cushioning layer 206 can comprise a vinyl-coated cloth tape (e.g., gaffer tape with a thickness of about 0.28 mm) can be applied to the wheel surface. The vinyl-coated cloth tape has a texture similar to fabric cloth, which increases the friction coefficient and helps to hold the abrasive 115 on its surface. The cushioning layer 206 can also include one or more layers of surgical tape and/or wool felt tape under the vinyl-coated cloth tape 206 to increase the overall deformability of the wheel surface. The abrasive 115 can comprise particles having a mean size of ≤4 μm and, in some cases, a mean size of ≤1 μm. For example, the abrasive particles can be 2-4 μm or 0-1 μm diamond abrasive. FIG. 3 shows an example of various aspects of the polishing system.

Figure 4A:
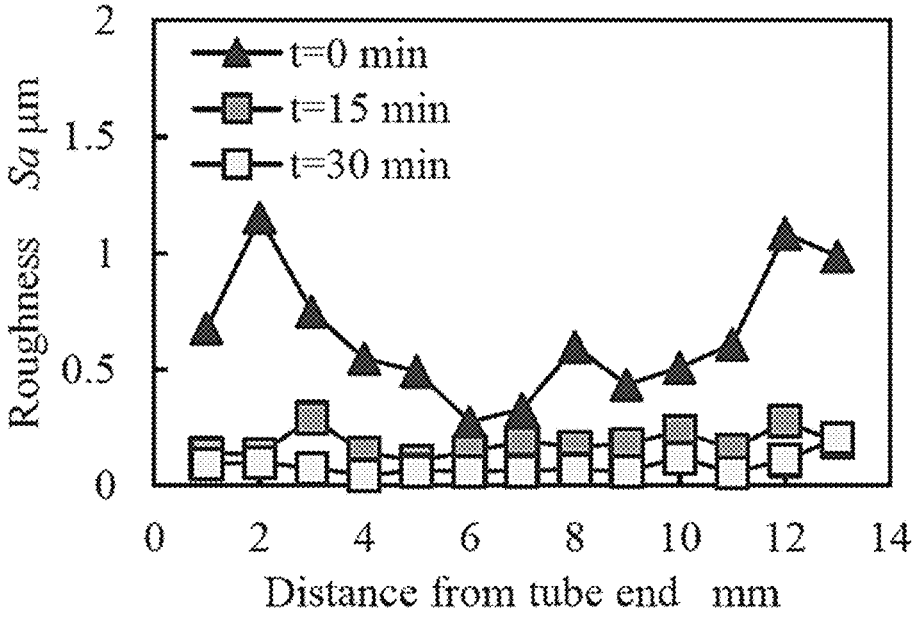
FIG. 4A through 4C are plots illustrating the effect of polishing the external surface of a tube utilizing the finishing system of FIG. 1, in accordance with various embodiments of the present disclosure.
Figure 4B:
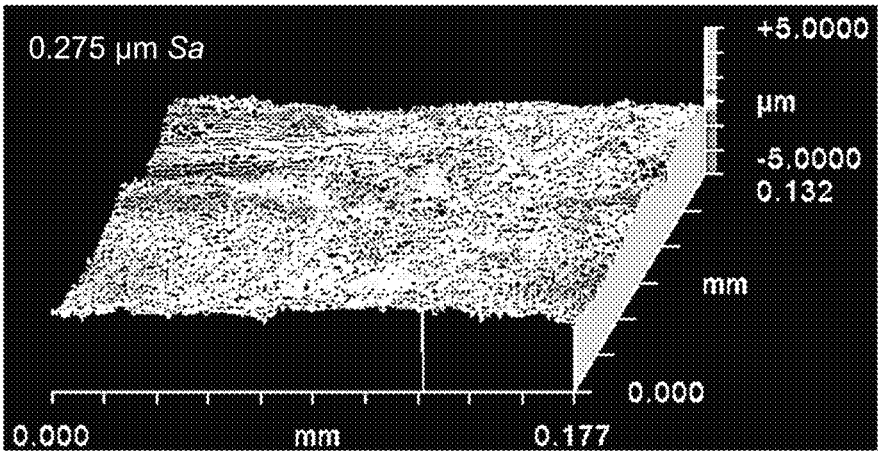
Figure 4C:
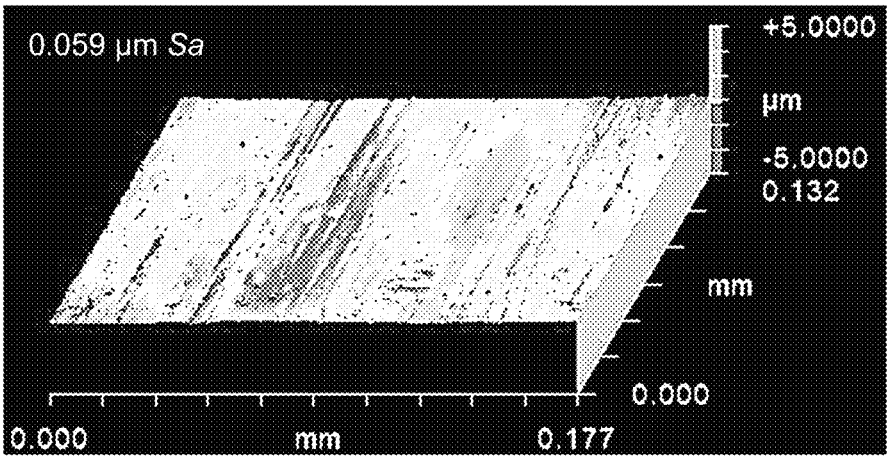

Referring next to FIG. 4A, shown are representative results of polishing a tube. To reduce adverse effects from irregular contact between the turning wheel 106 and workpiece 109, gaffer tape was applied over ten layers of surgical tape to form the cushioning layer 206, with a total thickness of about 1.2 mm. The surgical tape increased the overall deformability of the surface and reduced the bump effect at the tape end. The abrasive used was 0-1 μm diamond abrasive, and the finishing cycle time was 15 min. The surface was evenly and smoothly finished after two cycles (30 min total). FIGS. 4B and 4C show three-dimensional (3D) geometries of the tub surface as received and after the two cycles, respectively, at 6 mm from the tube end. This result proved that the wheel contact conditions are parameters that are important to successful finishing.

Surface Finishing of Stents

Modification of Experimental Setup.

Axial reciprocation of the workpiece 109 avoids repeatedly tracing the same paths on the surface, and can reduce or eliminate periodic scratches and ridges by creating a cross-hatch pattern on the workpiece surface. The axial reciprocation can be achieved by alternating the friction distribution between the turning wheel 106 and the ends of workpiece 109. By changing the tilt of the workpiece holder 203, the contact point with the workpiece 109 can be varied to linearly moves the workpiece 109 along the rod 112. Oscillation can be used to tilt the workpiece holder 203 up and down, and this up-and-down oscillation of the workpiece holder 203 can cause the workpiece 109 to oscillate axially while rotating.

Figure 5A:
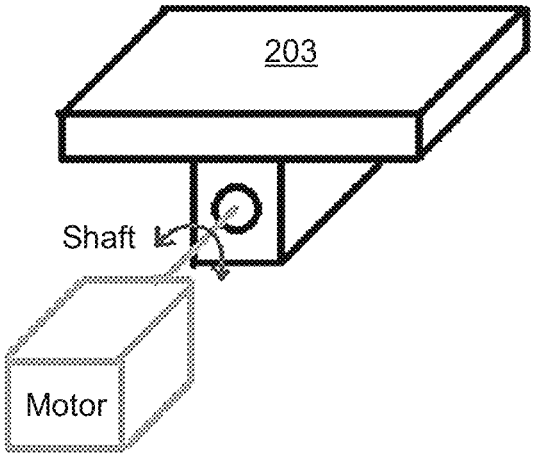
FIGS. 5A through 5C illustrate examples of methods for oscillating the workpiece holder of the finishing system of FIG. 1, in accordance with various embodiments of the present disclosure.
Figure 5B:
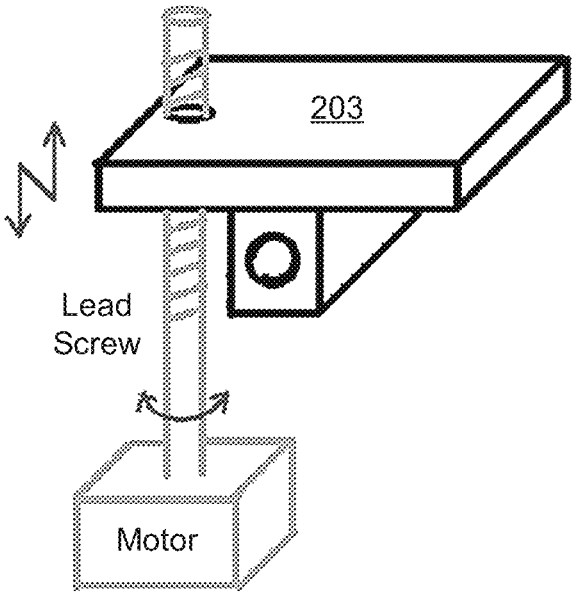
Figure 5C:
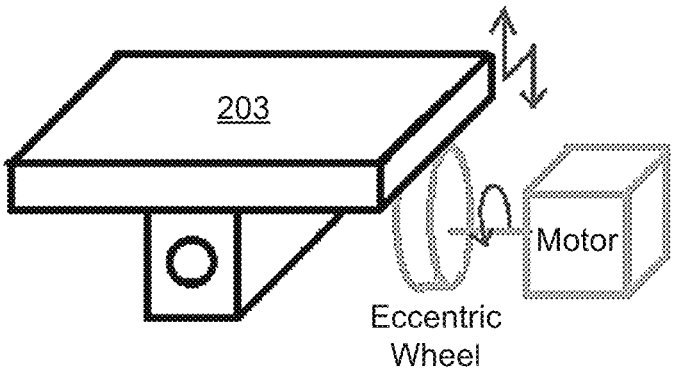

Referring to FIGS. 5A-5C, shown are examples of system for oscillating the workpiece holder 203. In FIG. 5A, a motor can oscillate the workpiece holder 203 directly through a shaft mounted to the workpiece holder 203. In FIG. 5B, the workpiece holder 203 can be oscillated through a lead screw passing through one side of the workpiece holder 203. In FIG. 5C, the workpiece holder 203 can be oscillated by an eccentric wheel positioned below one side of the workpiece holder 203. The motor can be coupled to the eccentric wheel directly or through a gear box. Since the tilting movement of the workpiece holder 203 is on the scale of a few degrees (e.g., 1-2 degrees), the eccentric wheel offers the solution. While accuracy is important in the machining and positioning of the eccentric wheel, it can convert continuous rotational movement to linear displacement of the workpiece holder 203 with accurate control of the tiling angle. The speed of the tilt variation can also be controlled by controlling the speed of the motor and/or by selecting the appropriate gear ratio. Additionally, in order to keep the plate of the workpiece holder 203 touching the eccentric wheel, one or more compression springs can be applied on the side of the plate opposite the eccentric wheel. By pressing the plate against the wheel, vibrations of the workpiece holder 203.

Figure 6A:
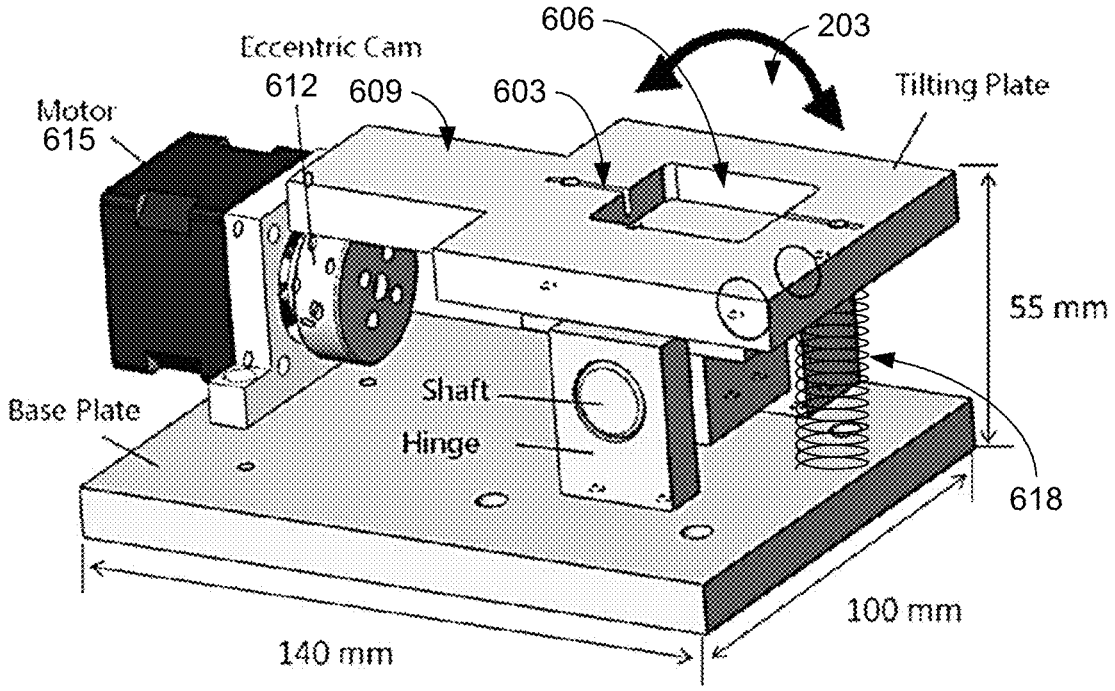

Referring to FIG. 6A, shown is an example of a workpiece holder assembly for oscillating the workpiece holder 203 with the eccentric wheel. The workpiece holder 203 includes grooves 603 on opposite sides of the recessed cavity 606 to hold the rod 112 in position. A hinge mounted on the base plate includes a shaft that passes through the lower section of the workpiece holder 203 to allow it to tilt about the shaft. The "tilting" plate of the workpiece holder 203 includes a cam arm 609 extending from a side of the workpiece holder 203 in a direction that is substantially perpendicular to the axial length of the shaft. The free end of the cam arm 609 is in contact with the eccentric wheel (or cam) 612, which is driven by a motor 615 (e.g., a stepping motor). One or more compression springs 618 provide a lever force that presses the free end of the cam arm 609 against the contact point of the eccentric wheel 612 to ensure continuous contact to avoid bumping and bouncing.

Figure 6B:
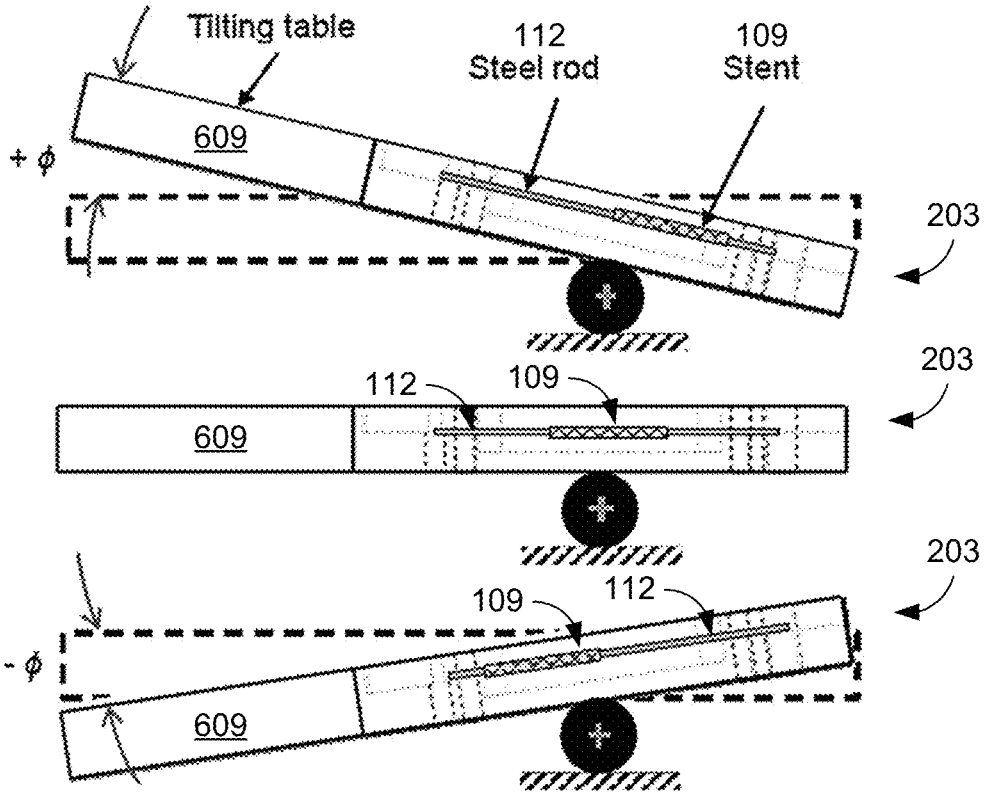

FIG. 6B illustrates the variation in the tilt of the workpiece holder 203 about the shaft as the eccentric wheel 612 rotates. As shown, the workpiece (stent) 109 moves along the rod 112 in response to the tilt. Movement of the stent 109 along the length of the rod 112 is limited by the walls of the recessed cavity 606. FIG. 6C is an image showing the cam arm 609 in contact with the eccentric cam 612 coupled to the motor 615. The speed of the motor 615 can be controlled through drive circuitry controlled by, e.g., a microcontroller to start, stop, reverse, or adjust the oscillation frequency. FIG. 6D shows an example of the eccentric wheel or cam 612, with an offset distance e=1.05 mm to provide a ±1° tilt angle of the workpiece holder 203. Other offset distances can be utilized to produce different tilt angles. The distance between the contact point of the wheel and the rotating center was 120 mm.

Figure 6F:
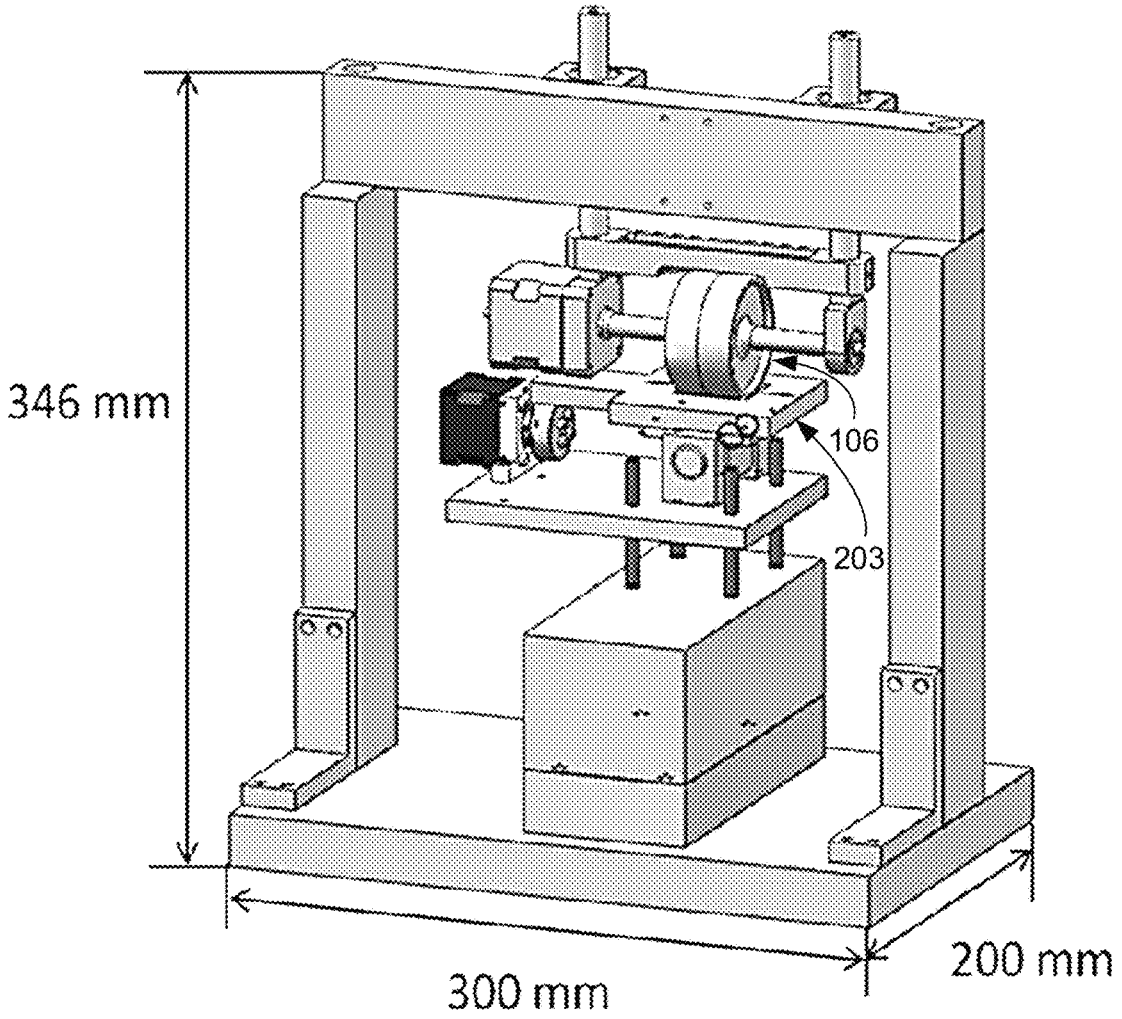

FIG. 6E is an image of an implemented polishing system including the workpiece holder assembly of FIG. 6A. A pair of compression springs 618 are located opposite the cam arm 609 to force the free end of the cam arm 609 against the contact point of the eccentric wheel 612. FIG. 6F is a graphical representation illustrating the polishing system including the workpiece holder assembly of FIG. 6E. As previously described, the turning wheel 106 is positioned over the workpiece holder 203 with linear slides to adjust contact force with a stent or workpiece in the workpiece holder 203.

Some finishing trials with tubes 109 showed that the lower friction between the workpiece 109 and wheel surface at the middle part of the workpiece 109 resulted in less finishing action in that area compared to the ends of workpiece 109. To overcome this issue, the wheel diameter was increased at the area corresponding to the middle of workpiece 109. An arc radius of 80 mm was empirically chosen for the wheel-surface geometry, resulting in a barrel-shaped wheel 106. The barrel shape was generated in this case by a clay mold. As the clay dried, cracks appeared in the surface, but they were covered by wool felt (1.59 mm thick), which replaced the surgical tape applied beneath the gaffer tape.

Figure 7A:
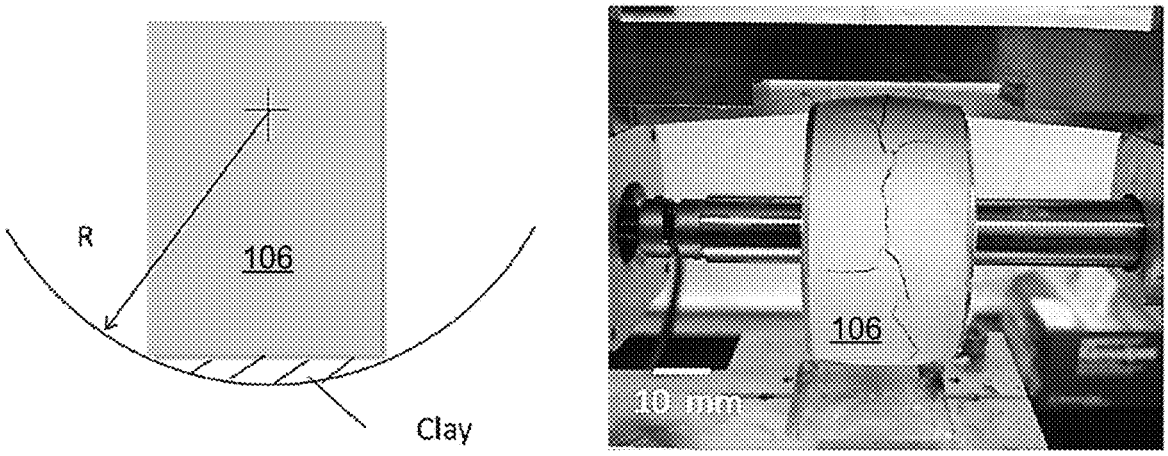
FIGS. 7A and 7B illustrate an example of a barrel-shaped turning wheel of the finishing systems of FIGS. 1 and 6A-6F, in accordance with various embodiments of the present disclosure.
Figure 7B:
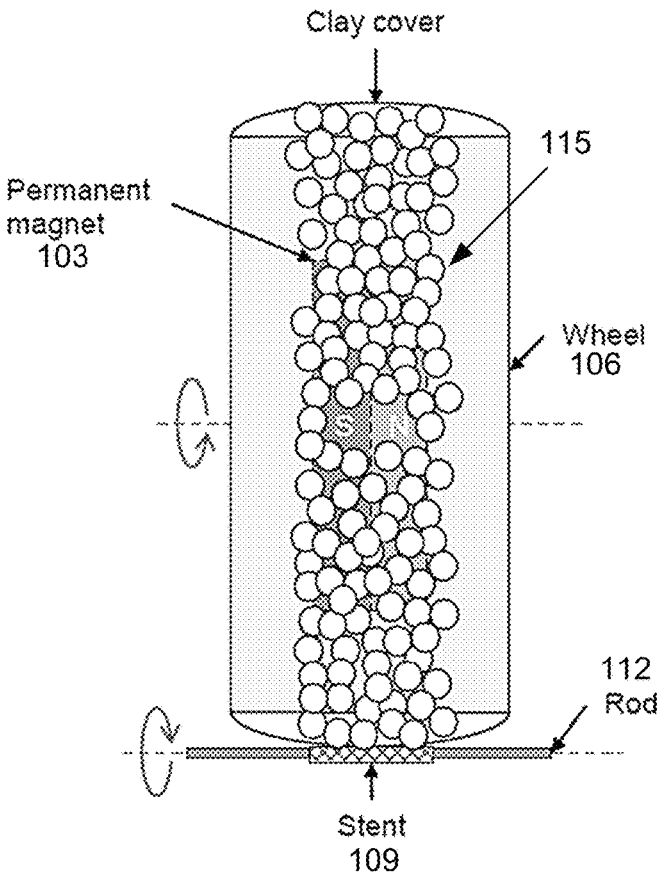

FIG. 7A illustrates the arc radius (R) to provide a larger wheel diameter in the center of the turning wheel 106, and an image of the resulting barrel-shaped wheel 106. In other embodiments, the turning wheel 106 can be machined to provide the appropriate arc radius. The extra firm wool felt placed over the wheel 106 exhibited excellent vibration absorption and elastic deformation during the process. FIG. 7B shows the barrel-shaped wheel 106 positioned against the stent 109 during polishing. The curvature and/or shape of the wheel-surface geometry can be adjusted by varying the cushioning layer 206 (FIG. 2C) applied over the surface of the turning wheel 106. For example, added layers of tape may be applied at different locations across the wheel 106 to increase or decrease the curvature, or to change the profile shape of the surface (e.g., by adding layers to one side).

Polishing of the inner surface of the stent or workpiece 109 can be provided by the polishing system. Since the rod 112 exerts a force against the inner surface, it may be polished by the relative motion between the two. Due to the mesh-like geometry of a stent 109, abrasive 115 introduced to the stent 109 will travel between the two surfaces through the gaps. In addition to finishing the side-walls of the stent 109, the abrasive 115 can promote polishing of the inner surface of the stent 109. To improve the polishing results, the rod 112 can wrapped with, e.g., fiber or thread before mounting the workpiece 109 on the rod 112. The wrapping can create a buffer of one or more layers between the rod 112 and the inner surface of the workpiece 109 that prevents ionization, and may assist in holding the abrasive 115 in place.

Figure 8:
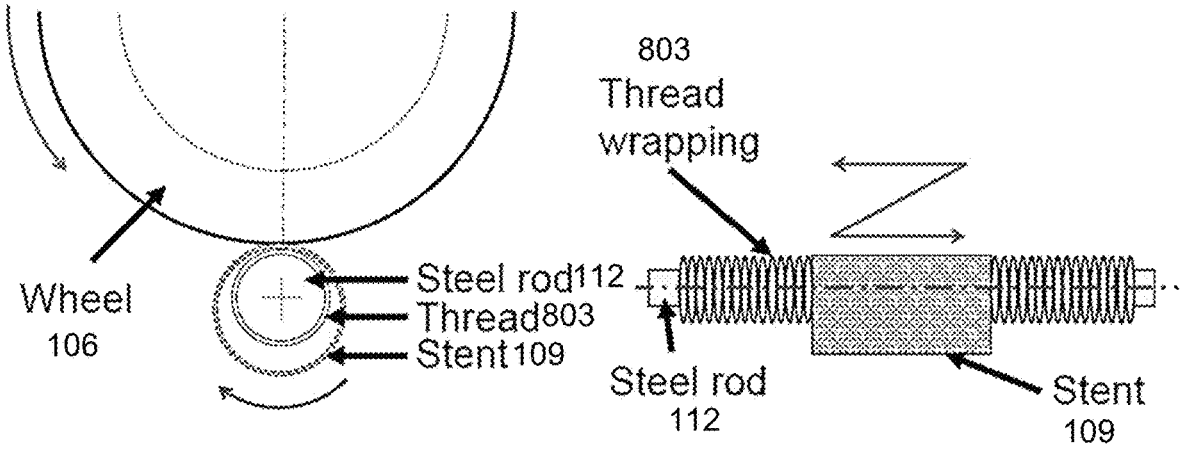
FIG. 8 illustrates an example of a wrapped-rod of the finishing systems of FIGS. 1 and 6A-6F, in accordance with various embodiments of the present disclosure.

FIG. 8 illustrates the wrapped-rod configuration. As in the previous description, a ferromagnetic rod 112 (e.g., a steel rod) is used to mount the workpiece 109 to preserve the magnetic attraction to the turning wheel 106. As shown in FIG. 8, a fiber or thread 803 is wrapped around the rod 112 in a continuous fashion such that it is sufficiently tight to prevent exposure of the surface. The diameter of the fiber or thread 803 should be small enough to fit at least one layer of wrapping inside the workpiece 109. The fiber or thread 803 should also be durable, absent of stray features or fibers, and should not hinder the magnetic attraction of the rod 112 towards the permanent magnet 103 in the wheel 106. In the case of a stent 109 with an internal diameter of 1.5 mm and a 1 mm steel rod, the fiber diameter should be smaller than 0.227 mm, or 31 AWG. Various fibers and threads were considered (e.g., dental floss, scrubbing fiber, fishing line, electrical wire and sewing thread), but the easiest to wrap around the rod 112 were 100% cotton, 100% polyester and coated hybrid polyester threads (e.g., 60% nylon, 40% polyester). The 100% polyester thread was utilized as it maintained its durability, while having a film-like surface that exhibited little deformation.

Finishing Characteristics of Stents.

AZ61 alloy stents (Ø1.8×Ø1.5×17 mm) were prepared as workpieces 109 for the finishing trials. Each stent 109 was held with a Ø1×70 mm carbon steel rod 112 (FIG. 1). The abrasive 115 (e.g., 0-1 μm diamond abrasive) was applied to the tape surface, and the wheel 106 was rotated at 200 $min^{-1}$. The motor 706 for the workpiece reciprocation was offset from the cam center by 1.05 mm, and the cam 703 was rotated at 80 $min^{-1}$, which created the axial reciprocation (right-and-left motion) of the workpiece 109. The finishing cycle time was fixed at 5 minutes.

Figure 9A:
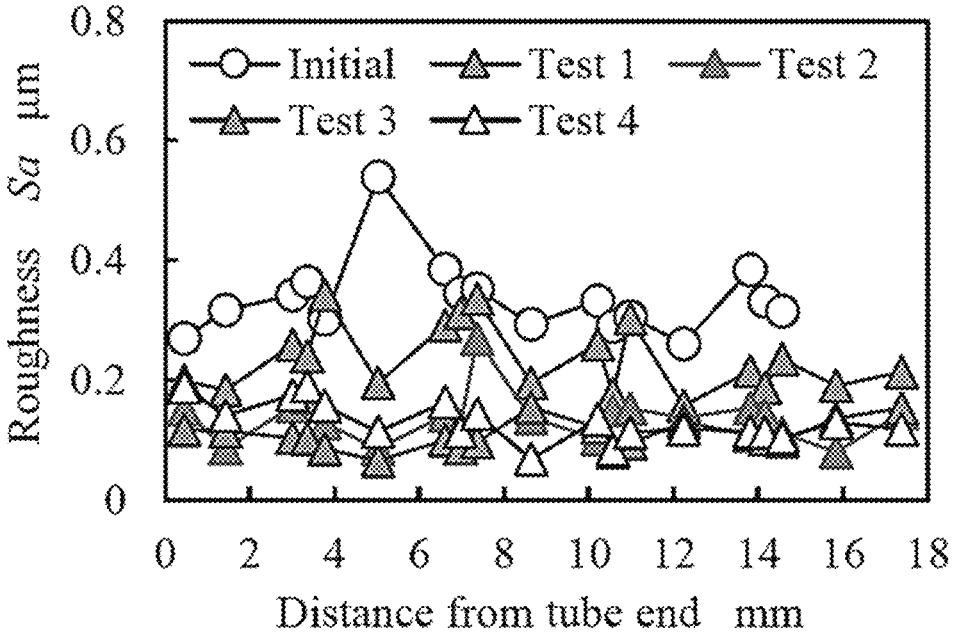
FIGS. 9A and 9B illustrate examples of the change in roughness of internal and external surfaces of a stent during the finishing experiments, in accordance with various embodiments of the present disclosure.
Figure 9B:
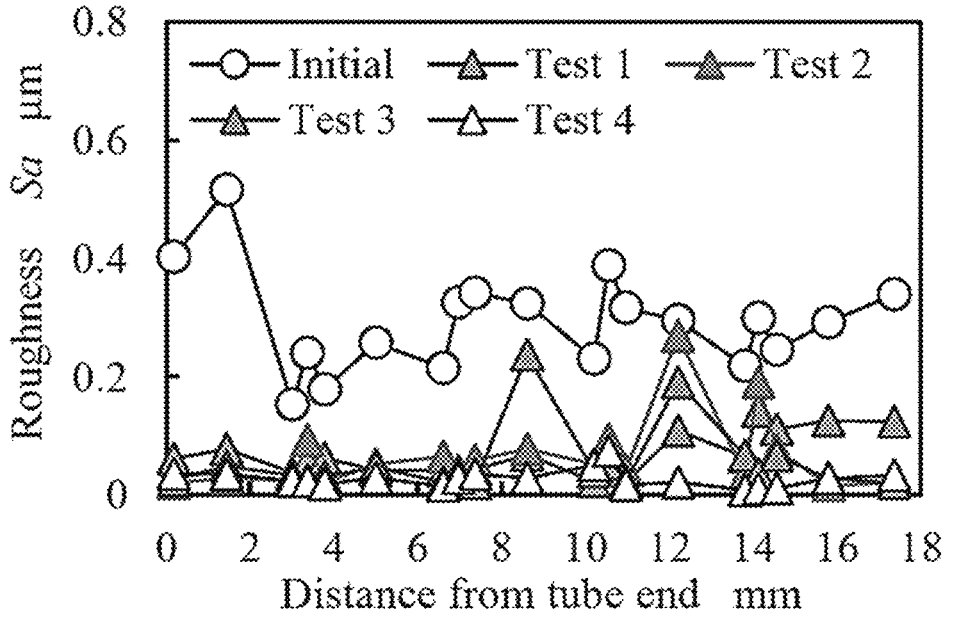

After finishing for four cycles of 5 minutes each (Test 1-Test 4), the external surface roughness was smoothed from 0.15-0.52 μm Sa to 0.02-0.14 μm Sa, and the internal surface roughness was smoothed from 0.27-0.54 μm Sa to 0.16-0.34 μm Sa. FIG. 9A shows the changes in roughness over the length of the internal surface of the stent 109 for Test 1-Test 4 and FIG. 9B shows the changes in roughness over the length of the external surface of the stent 109 for Test 1-Test 4.

Figure 9C:
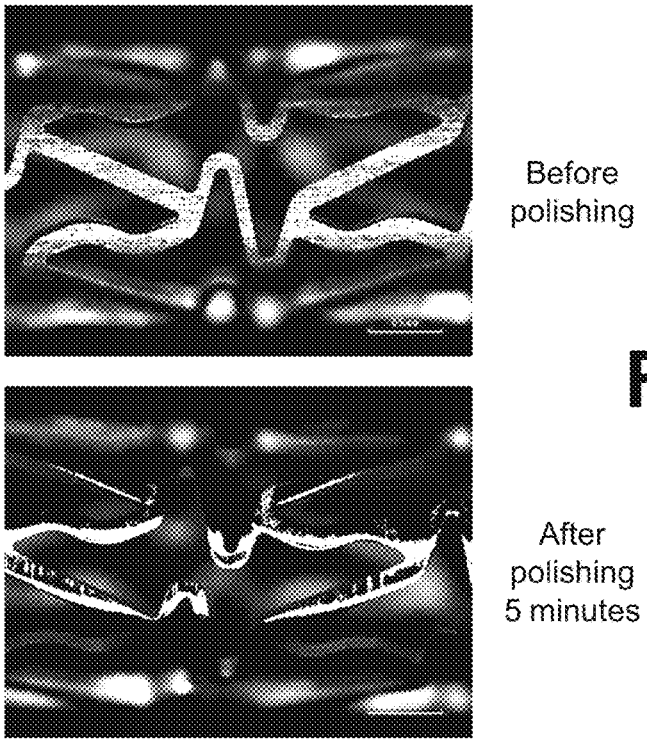
FIG. 9C includes images of an external surface of a stent before and after polishing using the finishing system of FIGS. 6A-6F, in accordance with various embodiments of the present disclosure.

The design of the workpiece 109 includes many holes to make it intrinsically deformable. This complicated the contact conditions between the wheel 106, workpiece 109, and rod 112; and raises difficulties in making stable contact between the wheel 106 and workpiece 109 while finishing. Although the external surface was well finished as illustrated in FIG. 9C, the internal surface was not as evenly finished, and there was less surface improvement. To overcome these issues, finishing conditions for a few additional cycles were set for effectively finishing of the internal surface rather than external surface. The workpiece 109 was inserted in a casing comprising a plastic tube (Ø2.4×Ø2.0×17 mm). Switching the source of rotation from the wheel-stent contact to the wheel-casing contact provided stable motion of the workpiece 109. A few additional cycles with the casing further improved the external and internal average surface roughnesses to about 0.03 and 0.11 μm Sa, respectively.

Figure 10A:
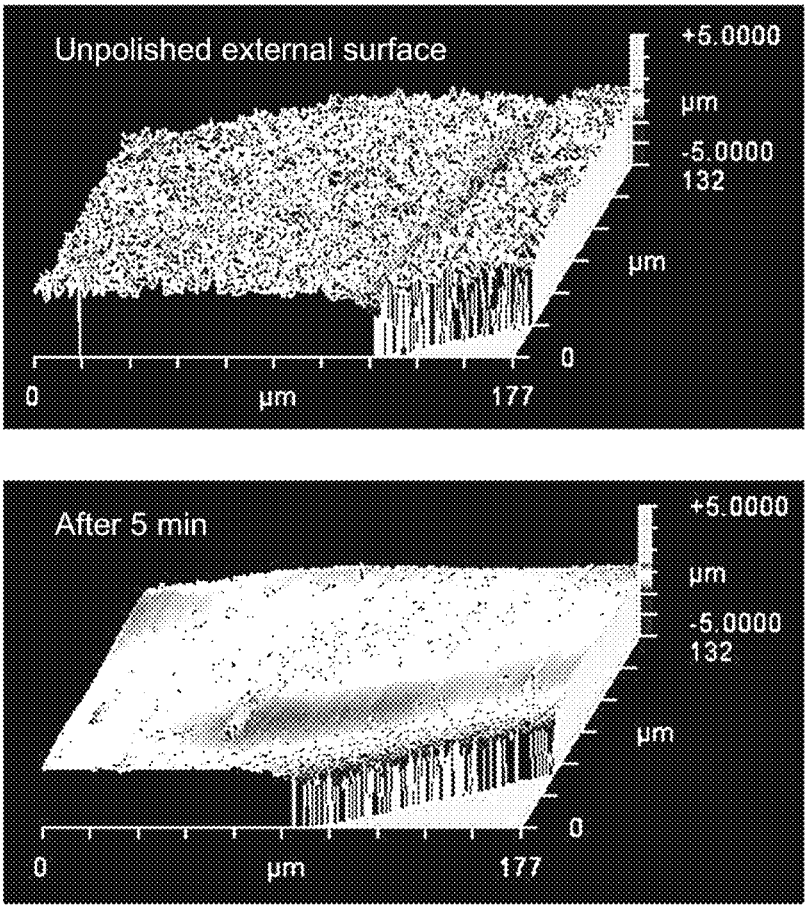
FIGS. 10A and 10B are topographies illustrating polishing of the external and internal surfaces of a stent using the finishing system of FIGS. 6A-6F, in accordance with various embodiments of the present disclosure.
Figure 10B:
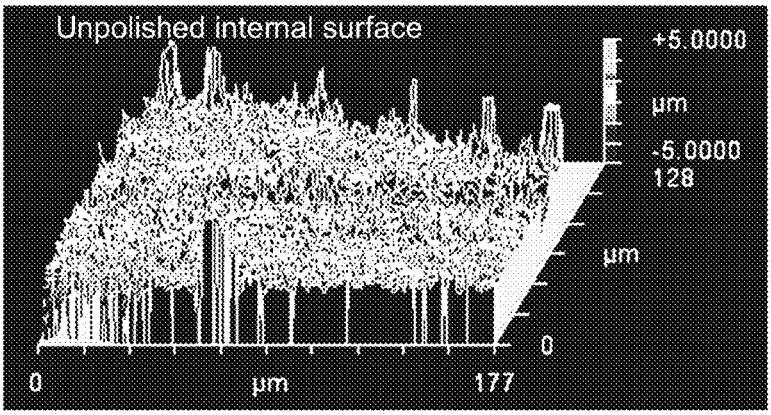
Figure 10B:
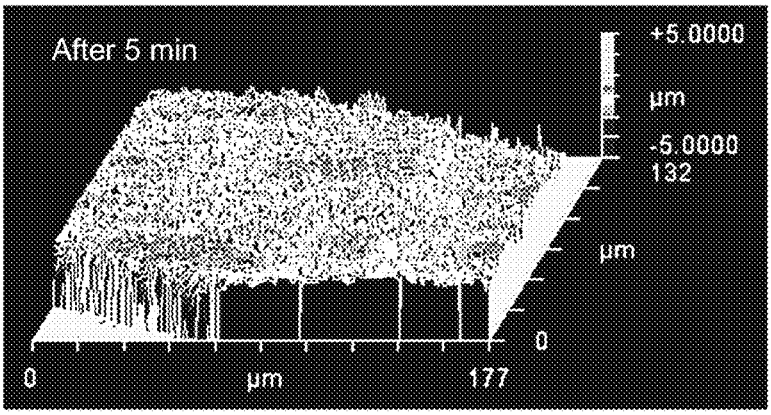
Figure 10C:
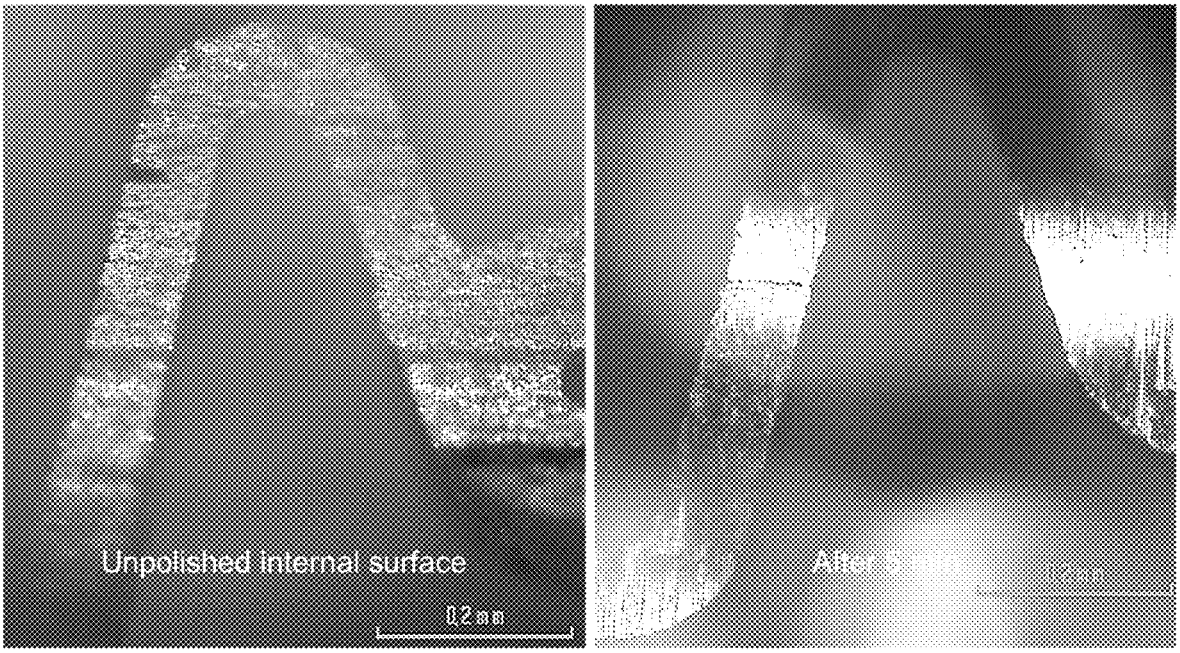

Testing was also carried out with a rod 112 wrapped with 100% polyester thread 803. The polishing process was carried out for 5 minutes with an abrasive 115 including diamond powder (0-1 μm diameter), a rotational speed of the wheel 106 of 200 $min^{-1}$, and a tilting angle of ±1.1°. FIGS. 10A and 10B illustrate the effects on the external and internal surfaces at 8 mm point along the stent 109, respectively. The topographies in FIG. 10A indicate a relatively large reduction in surface roughness of the external surface. The topographies in FIG. 10B show that the smaller tilting angle provided enough force to remove large peaks and dispersed protrusions of the internal surface. Utilizing a larger tilting angle may introduce additional reciprocation that can improve the surface treatment. FIG. 100 shows images of the internal surface of a stent 109 before polishing and after 5 minutes.

Applications of the disclosed finishing process and finishing system include:

- Surface and edge finishing of micro-components. The disclosed technology can finish the surfaces of components without rigidly clamping the components. This mechanism is beneficial for components that are not easily clamped or chucked.
- High-throughput machining. Since the disclosed technology does not utilize a chucking system for target components, offering the potential for high-throughput machining.

The disclosed technology is applicable for various materials, including metals, ceramics, and polymers.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A method, comprising:

supporting a tubular workpiece on a rod that extends axially through the tubular workpiece;

positioning an outer surface of a turning wheel against an external surface of the tubular workpiece, where the outer surface comprises abrasive particles and the external surface of the tubular workpiece is held against the outer surface by magnetic attraction between the rod and the turning wheel; and rotating the tubular workpiece by rotating the turning wheel, where the external surface of the tubular workpiece is polished by the abrasive particles during rotation of the tubular workpiece.

2. The method of claim 1, wherein the tubular workpiece is axially oscillated on the rod during rotation.

3. The method of claim 1, wherein the turning wheel has a cylindrical-shape or barrel-shape with a center diameter greater than an end diameter of the turning wheel, wherein the turning wheel is a magnetic turning wheel.

4. The method of claim 3, comprising rocking the rod about a center of the turning wheel thereby producing an axial reciprocation of the tubular workpiece.

5. The method of claim 1, wherein an internal surface of the tubular workpiece is polished during rotation of the tubular workpiece.

6. The method of claim 5, wherein the rod is wrapped in a thread or fiber.

7. The method of claim 1, wherein the tubular workpiece is a flexible tubular workpiece or a straight tubular workpiece.

8. The method of claim 7, wherein the flexible tubular workpiece is a stent.

9. A polishing system, comprising:

a workpiece holder comprising a rod configured to axially support a tubular workpiece;

a turning wheel comprising an internal magnet and abrasive particles distributed about an outer surface of the turning wheel;

a wheel support assembly configured to position the outer surface of the turning wheel against the an external surface of the tubular workpiece supported by the rod, where the external surface of the tubular workpiece is held against the outer surface by magnetic attraction between the rod and the internal magnet; and a turning wheel drive configured to turn the tubular workpiece on the rod by rotating the turning wheel, where the external surface of the tubular workpiece is polished by the abrasive particles during rotation of the tubular workpiece.

10. The polishing system of claim 9, wherein the workpiece holder is configured to axially oscillate the tubular workpiece on the rod during rotation by the turning wheel.

11. The polishing system of claim 10, wherein the workpiece holder is tilted in a rocking motion to cause the tubular workpiece to axially oscillate while rotating.

12. The polishing system of claim 10, wherein the workpiece holder is oscillated to axially reciprocate the tubular workpiece when rotated.

13. The polishing system of claim 9, wherein the turning wheel has a cylindrical-shape or barrel-shape with a center diameter greater than an end diameter of the turning wheel.

14. The polishing system of claim 13, wherein the outer surface of the turning wheel includes one or more layers of cushioning.

15. The polishing system of claim 9, wherein the internal magnet is a permanent magnet.

16. The polishing system of claim 9, wherein the rod is made of ferromagnetic materials.

17. The polishing system of claim 16, wherein the rod is coated with non-ferromagnetic materials.

18. The polishing system of claim 9, wherein the rod is wrapped in a thread or fiber.

19. The polishing system of claim 9, wherein the abrasive particles comprise abrasive particles having a mean diameter of less than or equal to 4 μm.

20. The polishing system of claim 19, wherein the abrasive particles have a mean diameter of less than or equal to 1 μm.

21. The polishing system of claim 9, wherein the tubular workpiece is a straight tubular workpiece or flexible tubular workpiece.

22. The polishing system of claim 9, wherein the tubular workpiece is a biodegradable stent.

* * * * *